US009978483B2

(12) United States Patent
Lee

(10) Patent No.: US 9,978,483 B2
(45) Date of Patent: May 22, 2018

(54) SURGE-RESISTANT WIRE-WOUND RESISTOR AND METHOD FOR MANUFACTURING SAME

(71) Applicant: FIRST RESISTOR & CONDENSER CO., LTD., Taipei (TW)

(72) Inventor: Shang-Yo Lee, Taipei (TW)

(73) Assignee: FIRST RESISTOR & CONDENSER CO., LTD., Taipei (TW)

( * ) Notice: Subject to any disclaimer, the term of this patent is extended or adjusted under 35 U.S.C. 154(b) by 0 days. days.

(21) Appl. No.: 15/108,570

(22) PCT Filed: Jan. 17, 2014

(86) PCT No.: PCT/CN2014/070761

§ 371 (c)(1),
(2) Date: Jun. 27, 2016

(87) PCT Pub. No.: WO2015/106426

PCT Pub. Date: Jul. 23, 2015

(65) Prior Publication Data

US 2016/0329135 A1 Nov. 10, 2016

(51) Int. Cl.

| | |
|---|---|
| ***H01C 1/034*** | (2006.01) |
| ***H01C 3/20*** | (2006.01) |
| ***H01C 17/04*** | (2006.01) |
| ***H01C 17/28*** | (2006.01) |
| ***H01C 1/14*** | (2006.01) |
| ***H01C 1/144*** | (2006.01) |

(52) U.S. Cl.

CPC ..... *H01C 3/20* (2013.01); *H01C 1/14* (2013.01); *H01C 1/144* (2013.01); *H01C 17/04* (2013.01); *H01C 17/288* (2013.01)

(58) Field of Classification Search

CPC ..... H01C 3/20; H01C 17/04; H01C 17/288
USPC ..... 338/266
See application file for complete search history.

(56) References Cited

U.S. PATENT DOCUMENTS 2,408,093 A * 9/1946 Patterson ..... H01C 17/04 29/610.1
2,537,061 A * 1/1951 Kohring ..... H01C 1/14 29/621

(Continued)

FOREIGN PATENT DOCUMENTS

CN 201838410 * 5/2011
JP 198321 * 1/1983

OTHER PUBLICATIONS

CN201838410 dated May 2011, EPO English translation.*
JPS5821 (JP198321A) dated Jan. 1983, EPO English translation.*

*Primary Examiner* — Kyung Lee
(74) *Attorney, Agent, or Firm* — Hannah M. Tien

(57) ABSTRACT

The present invention relates to a surge-resistant wire-wound resistor and a manufacturing method thereof, wherein soldering points, at which a cap at each end of the wire-wound resistor is soldered, are electroplated with an electroplated metal layer to significantly improve the reliability of soldering points. The surge-resistant wire-wound resistor comprises a ceramic rod; one or more than one wound metal wire; a first cap and a second cap; a first lead wire and a second lead wire, wherein the first cap and the second cap are respectively electroplated to have a first cap electroplated layer and a second cap electroplated layer.

8 Claims, 7 Drawing Sheets

(56) References Cited

U.S. PATENT DOCUMENTS

| | | | | | |
|---|---|---|---|---|---|
| 2,792,620 | A | * | 5/1957 | Kohring | H01C 7/04<br>29/620 |
| 3,205,467 | A | * | 9/1965 | Ganci | H01C 1/034<br>174/DIG. 8 |
| 3,229,237 | A | * | 1/1966 | Berkelhamer | H01B 3/085<br>338/264 |
| 3,248,679 | A | * | 4/1966 | Ganci | H01B 1/02<br>338/264 |
| 3,295,090 | A | * | 12/1966 | Hay | H01C 1/084<br>165/185 |
| 3,643,200 | A | * | 2/1972 | Brandi | H01C 1/144<br>338/258 |

* cited by examiner

SURGE-RESISTANT WIRE-WOUND RESISTOR AND METHOD FOR MANUFACTURING SAME

FIELD OF THE INVENTION

The present invention relates to a surge-resistant wire-wound resistor and a manufacturing method thereof, especially a wire-wound resistor whose soldering points, at which a cap is soldered at each end of the resistor, are electroplated to form an electroplated metal layer to significantly improve the reliability of soldering points.

BACKGROUND OF THE INVENTION

The structure of a conventional wire-wound resistor is shown in FIG. 1 and FIG. 2. In FIG. 2, the wire-wound resistor 10 comprises a ceramic rod 11, wherein the right end and left end of the ceramic rod 11 are respectively connected to a first iron cap 121 at the right end and a second iron cap 122 at the left end, and a wound metal wire 13, which is helically wound around the ceramic rod 11 along the circumference of the ceramic rod 11 from a wire head 131 on the first iron cap 121 to a wire tail 132 on the second iron cap 122, the wire head 131 of the wound metal wire 13 is subsequently soldered and fixed onto a wire-head soldering point 1311 of the first iron cap 121 by an electric soldering machine, and the wire tail 132 of the wound metal wire 13 is soldered and fixed on a wire-tail soldering point 1321 of the second iron cap 122, and then a first lead wire 141 and a second lead wire 142 extend respectively from the right of the first iron cap 121 and the left of the second iron cap 122 to form a conventional wire-wound resistor.

A wire-wound resistor is not the mainstream as to conventional surge-resistant resistors. When the transient energy of a surge wave is more than 100 watts, the surge loosens a certain proportion of the wound wires at the soldering points, which affects the surge resistance. In other words, for a conventional wire-wound resistor, when a wire head or a wire tail is soldered onto an iron cap obliquely or the soldering penetrates too deeply or not deep enough (as shown in FIG. 1, the wire tail 932 of the wound wire 93 is soldered obliquely at the soldering point 9321 of the second iron cap 922 on the ceramic rod 91), the contact resistance between the soldering point and the iron cap increases because the soldering points are soldered poorly (for example a soldering machine). Therefore, a surge event may loosen the soldering points and a certain failure rate of the soldering points of a wire-wound resistor may ensue. The failure rate of the surge-resistant soldering points of a conventional wire-wound resistor is approximately 10 ppm. Because the failure rate of the aforementioned surge-resistant soldering points is still high, the wire-wound resistor industry is eagerly looking for a surge-resistant wire-wound resistor which has highly reliable surge-resistant soldering points.

Owing to the aforementioned drawbacks of prior arts, the present invention provides a highly reliable wire-wound resistor to decrease the failure rate of the surge-resistant soldering points and to improve the surge-resistance reliability.

DETAILED DESCRIPTION OF THE INVENTION

According to the first embodiment of the present invention, the main purpose of the present invention is to provide a surge-resistant wire-wound resistor, comprising:

a ceramic rod which has a first end and a second end;

one or more than one wound metal wire which has a wire head and a wire tail and is helically wound around the ceramic rod from the first end to the second end;

a first cap and a second cap which are respectively disposed along an axis of the ceramic rod and extending outwardly from the first end and the second end, wherein the wire head and the wire tail are respectively soldered on the surfaces of the first cap and the second cap at the first cap and the second cap, and the first cap and the second cap are respectively electroplated with a first cap electroplated layer and a second cap electroplated layer; and a first insulating layer which is disposed on the surface of the ceramic rod and covers the surfaces of the ceramic rod and the wound metal wire.

According to the second embodiment of the present invention, the surge-resistant wire-wound resistor of the present invention further comprises a first lead wire and a second lead wire which are respectively disposed along an axial axis of the ceramic rod and extending outwardly from the first cap and the second cap.

According to the second embodiment of the present invention, the surge-resistant wire-wound resistor of the present invention further comprises a second insulating layer which is disposed on and covers the surface of the first insulating layer and the surfaces of the first cap electroplated layer and the second cap electroplated layer.

According to the present invention, preferably, the first cap electroplated layer is selected from the group consisting of, but not limited to, tin, copper, iron, silver, nickel and alloys thereof.

According to the present invention, preferably, the thickness of the first cap electroplated layer is from 1 μm to 10 μm.

According to the present invention, preferably, the second cap electroplated layer is selected from the group consisting of, but not limited to, tin, copper, iron, silver, nickel and alloys thereof.

According to the present invention, preferably, the thickness of the second cap electroplated layer is from 1 μm to 10 μm.

According to the present invention, preferably, the material of the first insulating layer is epoxy resin, nonflammable silicone paint or enamel paint.

According to the present invention, preferably, the material of the second insulating layer is epoxy resin, nonflammable silicone paint or enamel paint.

According to the first embodiment of the present invention, another purpose of the present invention is to provide a manufacturing method for a surge-resistant wire-wound resistor, comprising the steps of:

providing a ceramic rod;

mounting a first cap and a second cap respectively on a first end and a second end of the ceramic rod;

winding a wound metal wire around the circumference of the ceramic rod;

soldering two ends of the wound metal wire on the first cap and the second cap;

coating a first insulating layer on surrounding of the ceramic rod; and electroplating respectively a cap electroplated layer on surfaces of the first cap and the second cap.

According to the second embodiment of the present invention, the manufacturing method of the present invention further comprises a step of: connecting a first lead wire and a second lead wire to an axially extended line of the ceramic rod and respectively extending the first lead wire and the second lead wire outwardly from the first cap and the second cap.

According to the second embodiment of the present invention, the manufacturing method of the present invention further comprises a step of: coating a second insulating layer on the surface of the first insulating layer and the surfaces of the first cap electroplated layer and the second cap electroplated layer.

EXAMPLES

Figure 1:
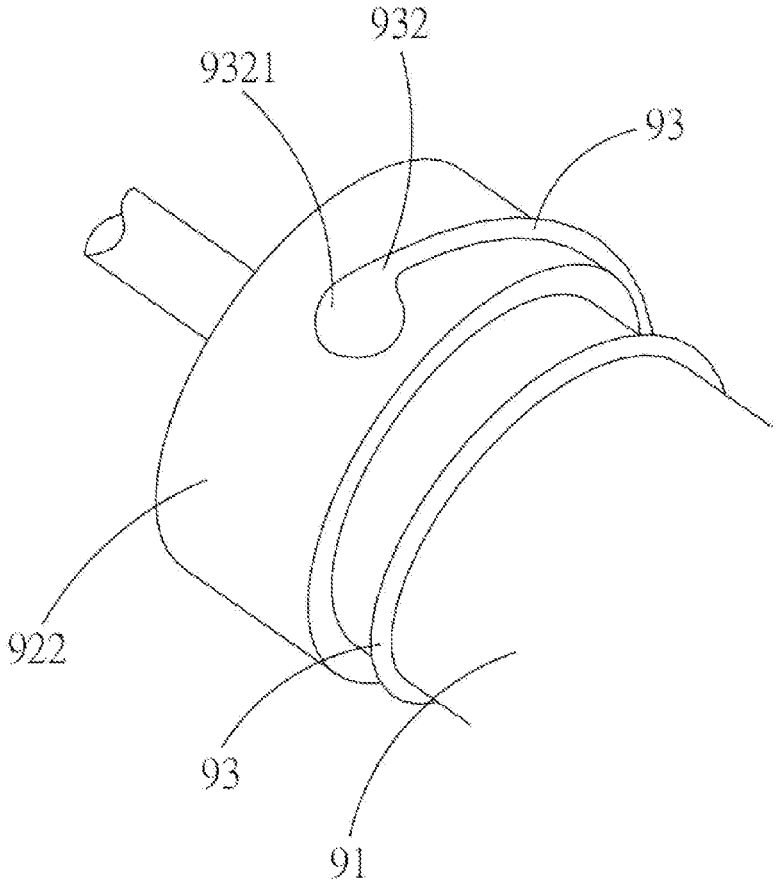
FIG. 1 is a schematic diagram showing that a conventional wire-wound resistor is soldered obliquely.
Figure 2:
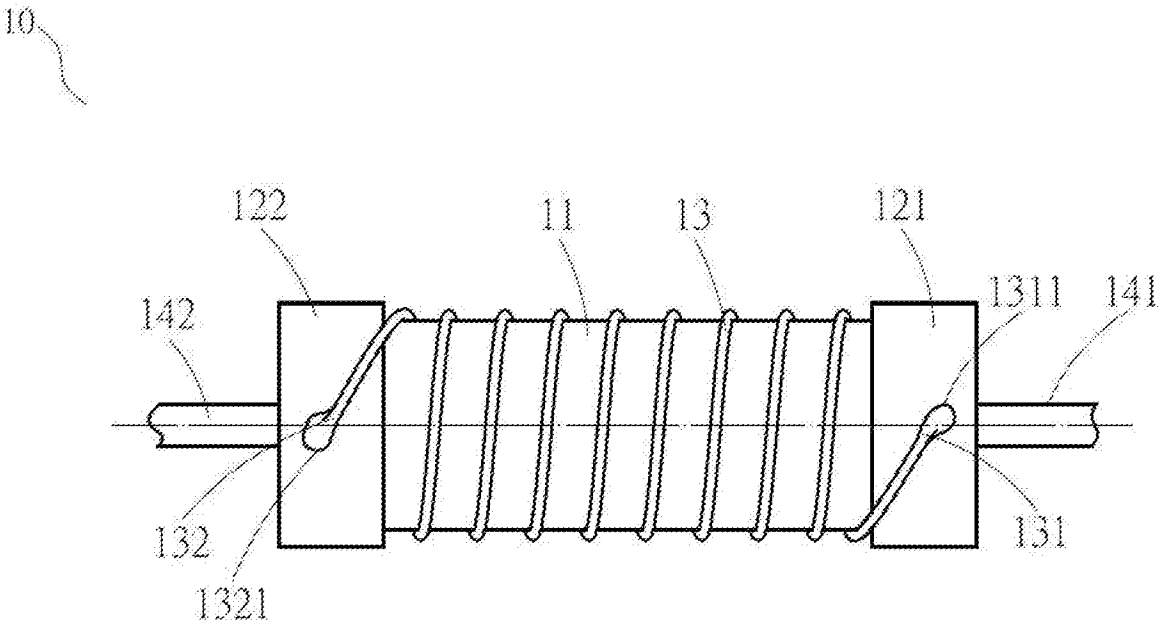
FIG. 2 is a side view diagram of a conventional wire-wound resistor.

As shown in FIG. 3A, FIG. 3B, FIG. 4A and FIG. 4B, according to the first example of the present invention (the MELF type of wire-wound resistor), the present invention provided a surge-resistant wire-wound resistor 20, comprising:

a ceramic rod 21 which had a first end 211 and a second end 212;

one or more than one wound metal wire 23 which had a wire head 231 and a wire tail 232 and was helically wound around the ceramic rod from the first end 211 to the second end 212;

a first cap 221 and a second cap 222 which were respectively disposed along an axis of the ceramic rod 21 and extending outwardly from the first end 211 and the second end 212, wherein the wire head 231 and the wire tail 232 were respectively soldered on the surfaces of the first cap 221 and the second cap 222 at the first cap 221 and the second cap 222, and the first cap 221 and the second cap 222 were respectively electroplated with a first cap electroplated layer 2211 on the surface of the first cap 221 and a second cap electroplated layer 2221 on the surface of the second cap 222; and a first insulating layer 2111 which was disposed on the surface of the ceramic rod 21 and covered the surfaces of the ceramic rod 21 and the wound metal wire 23.

According to the second example of the present invention (a type of the wire-wound resistor with winding wires), the present invention provided a surge-resistant wire-wound resistor 420, comprising:

a ceramic rod 421 which had a first end 4211 and a second end 4212; one or more than one wound metal wire 423 which had a wire head 4231 and a wire tail 4232 and was helically wound around the ceramic rod 421 from the first end 4211 to the second end 4212;

a first cap 4221 and a second cap 4222 which were respectively disposed along an axis of the ceramic rod 421 and extending outwardly from the first end 4211 and the second end 4212, wherein the wire head 4231 and the wire tail 4232 were respectively soldered on the surfaces of the first cap 4221 and the second cap 4222 at the first cap 4221 and the second cap 4222, and the first cap 4221 and the second cap 4222 were respectively electroplated with a first cap electroplated layer 42211 on the surface of the first cap 4221 and a second cap electroplated layer 42221 on the surface of the second cap 4222;

a first insulating layer 42111 which was disposed on the surface of the ceramic rod 421 and covered the surfaces of the ceramic rod 421 and the wound metal wire 423;

a first lead wire 4241 and a second lead wire 4242 which were respectively disposed along an extended line of the axle center 4213 of the ceramic rod 421 and extending outwardly from the first cap 4221 and the second cap 4222; and a second insulating layer which was disposed on and covered the surface of the first insulating layer 42111 and the surfaces of the first cap 4221 and the second cap 4222.

The ceramic rod 21, 421 of the present invention was made of, but not limited to, insulating materials. Any insulating cylinders which could achieve the goal of the present invention could be used, for example, a white ceramic rod or a glass fiber cylinder.

The first cap 221, 4221 and the second cap 222, 4222 were mounted on two ends of the ceramic rod 21, 421. Materials of the first cap 221, 4221 and the second cap 222, 4222 could be, but not limited to, metals such as iron, steel, aluminum, copper, or other alloys or graphite materials. Any materials which could fulfill the function of the cap could be used.

Figure 3A:
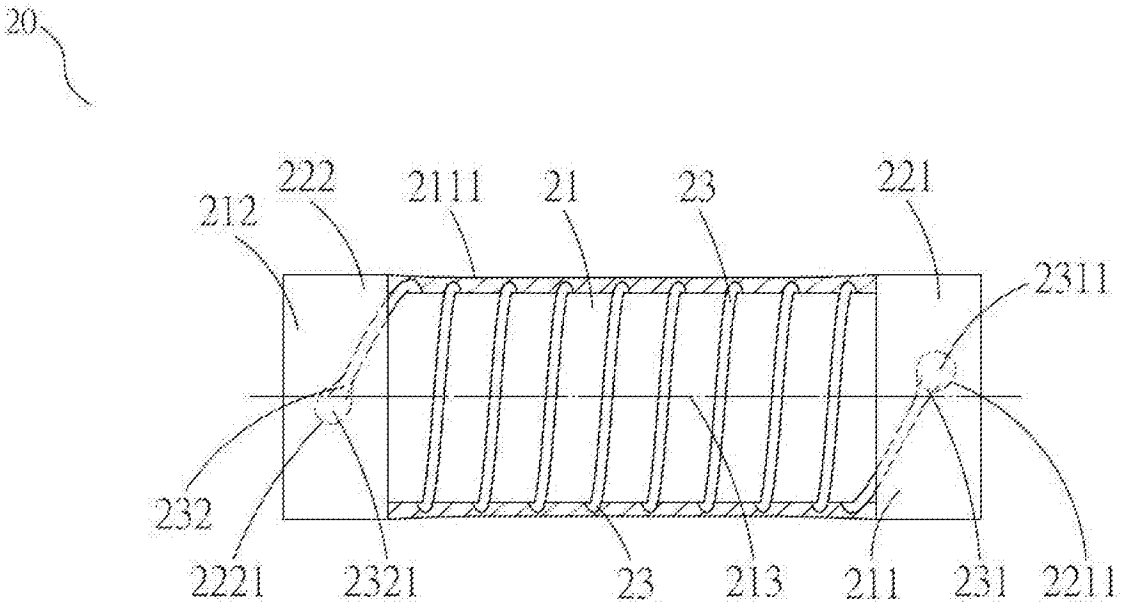
FIG. 3A is a side view diagram of the first embodiment of a wire-wound resistor of the present invention.
Figure 3B:
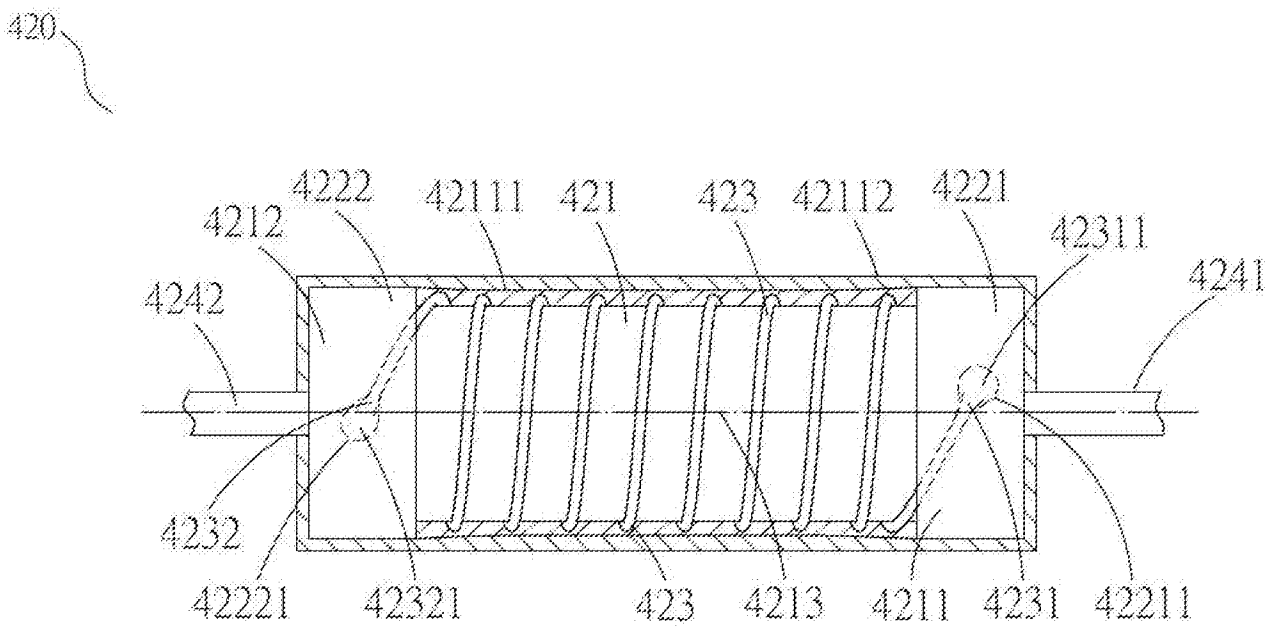
FIG. 3B is a side view diagram of the second embodiment of a wire-wound resistor of the present invention.

As shown in FIG. 3A and FIG. 3B, the wire head 231, 4231 was soldered onto the first cap 221, 4221 at a wire-head soldering point 2311, 42311; the wire tail 232, 4232 was soldered onto the second cap 222, 4222 at a wire-tail soldering point 2321, 42321.

Figure 4A:
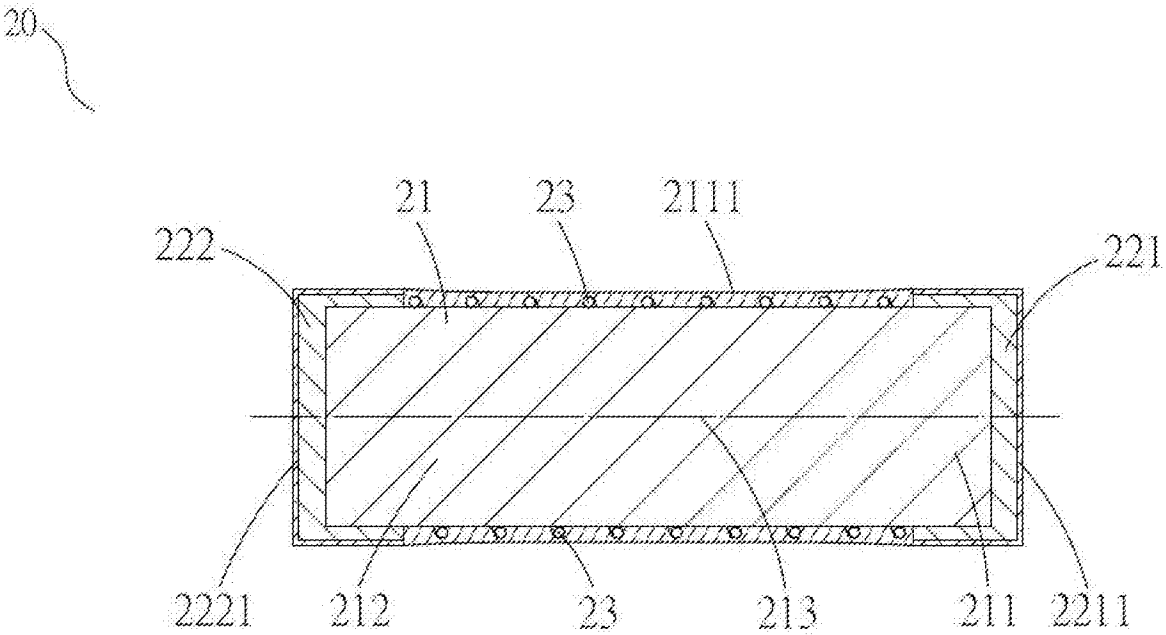
FIG. 4A is a diagram illustrating a cross section of the first embodiment of a wire-wound resistor of the present invention.
Figure 4B:
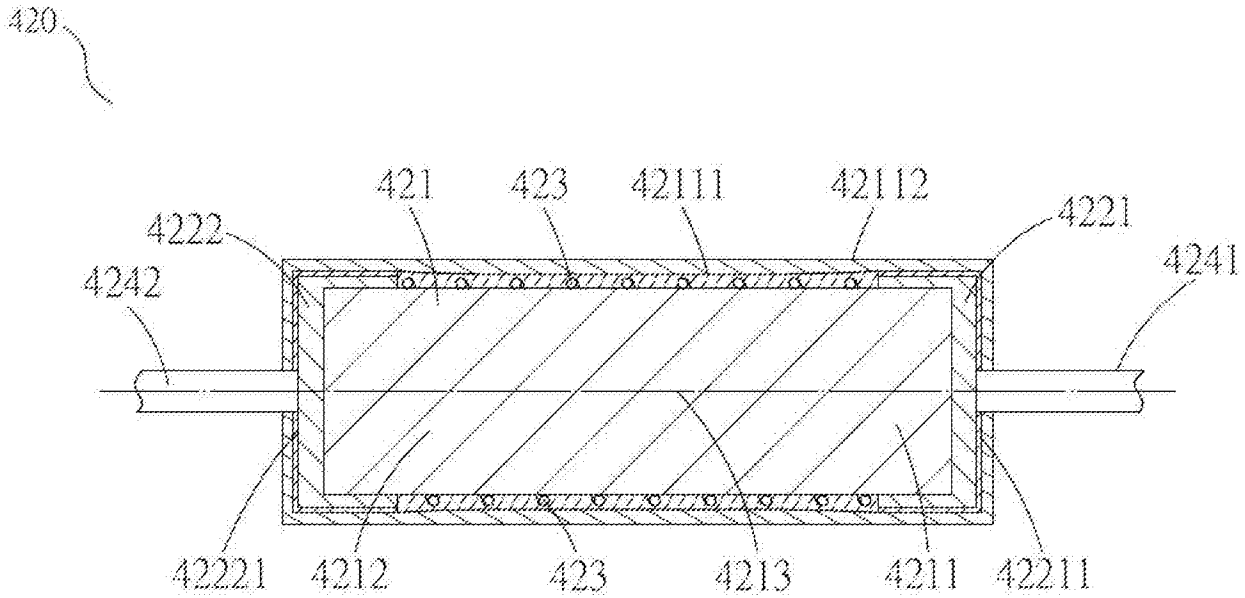
FIG. 4B is a diagram illustrating a cross section of the second embodiment of a wire-wound resistor of the present invention.

As shown in 4A and FIG. 4B, the first cap electroplated layer 2211, 42211 and the second cap electroplated layer 2221, 42221 of the present invention were respectively formed on the first cap 221, 4221 and the second cap 222, 4222 by using an industrial electroplating process, wherein the electroplated layer of the first cap electroplated layer 2211, 42211 and the second cap electroplated layer 2221, 42221 were in material selected from the group consisting of, but not limited to, tin, copper, iron, silver, nickel and alloys thereof.

Figure 5:
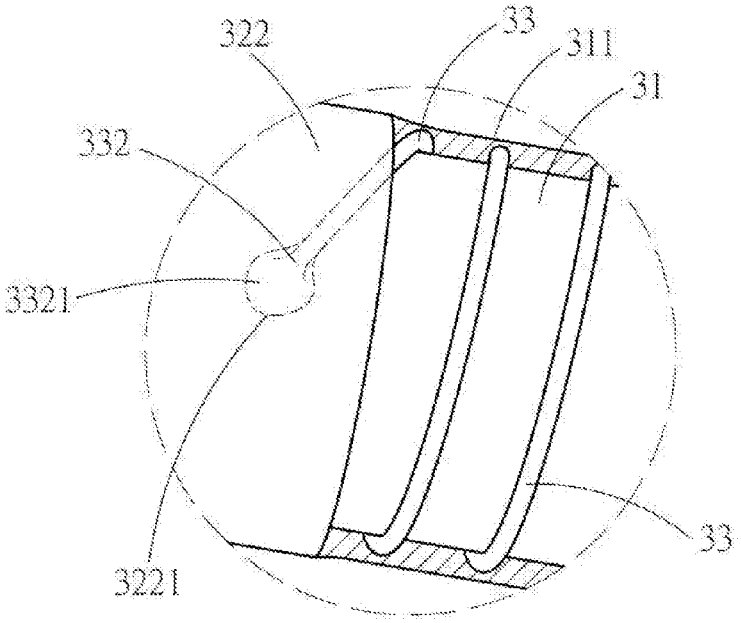
FIG. 5 is a schematic diagram showing a soldering point of a wire-wound resistor of the present invention.

As shown in FIG. 5, as to the wire-wound resistor of the present invention, the wire tail 332 of the wound metal wire 33 wound around the ceramic rod 31 was soldered onto the surface of the cap 322, and a cap electroplated layer 3221 was formed on the soldering point 3321.

As shown in FIG. 3A and FIG. 4A, according to the first example of the present invention, the present invention provided a manufacturing method for a surge-resistant wire-wound resistor, comprising the steps of:

providing a ceramic rod 21;

mounting a first cap 221 and a second cap 222 respectively on a first end 211 and a second end 212 of the ceramic rod 21;

winding a wound metal wire 23 around the circumference of the ceramic rod 21;

soldering two ends of the wound metal wire 23 onto the first cap 221 and the second cap 222;

coating a first insulating layer 2111 on surrounding of the ceramic rod 21; and electroplating surfaces of the first cap 221 and the second cap 222 to form a cap electroplated layer 2211 and a cap electroplated layer 2221, respectively.

As shown in FIG. 3B and FIG. 4B, according to the second example of the present invention, the present invention provided a manufacturing method for a surge-resistant wire-wound resistor, comprising:

providing a ceramic rod 421;

winding a wound metal wire 423 around the circumference of the ceramic rod 421;

mounting a first cap 4221 and a second cap 4222 respectively on a first end 4211 and a second end 4212 of the ceramic rod 421;

soldering two ends of the wound metal wire 423 onto the first cap 4221 and the second cap 4222;

coating a first insulating layer 42111 on surrounding of the ceramic rod;

electroplating surfaces of the first cap 4221 and the second cap 4222 respectively to form a cap electroplated layer 42211 and a cap electroplated layer 42221;

connecting a first lead wire 4241 and a second lead wire 4242 to an extended line of the axial center of the ceramic rod 421 and extending them outwardly from the first cap 4221 and the second cap 4222; and coating a second insulating layer 42112 on a surface of the first insulating layer 42111 and surfaces of the cap electroplated layer 42211 and the cap electroplated layer 42221.

In the present invention, because the first cap and the second cap were respectively electroplated to have a cap electroplated layer, the strength of the soldering points was increased, the failure rate was decreased, and the reliability of the soldering points was further improved. Therefore, the failure rate of the surge-resistant soldering point of the wire-wound resistor provided by the present invention was less than 0.1 ppm.

The wire-wound resistor provided by the present invention could be used not only in surge-resistant circuits, but also in spark plug covers for the motor vehicle and motorcycle industry and ignition systems for automobiles.

The structures and examples aforementioned are illustrated for fully realizing the present invention and should not be construed to limit the scope of the invention. One skilled in the art may modify and vary the examples without departing from the spirit and scope of the present invention.

What is claimed is:

1. A surge-resistant wire-wound resistor, comprising:

a ceramic rod which has a first end and a second end;

one or more than one wound metal wire which has a wire head and a wire tail and is helically wound around the ceramic rod from the first end to the second end;

a first cap and a second cap which are respectively disposed along an axis of the ceramic rod and extending outwardly from the first end and the second end, wherein the wire head and the wire tail are respectively soldered onto surfaces of the first cap and the second cap at the first cap and the second cap, and the first cap and the second cap are then respectively electroplated with a first cap electroplated layer and a second cap electroplated layer;

a first insulating layer which is disposed on a surface of the ceramic rod and covers surfaces of the ceramic rod and the wound metal wire;

a first lead wire and a second lead wire which are respectively disposed along an axially extended line of the ceramic rod and extending outwardly from the first cap and the second cap; and a second insulating layer which is disposed on and covers a surface of the first insulating layer and surfaces of the first cap electroplated layer and the second cap electroplated layer.

2. The surge-resistant wire-wound resistor of claim 1, wherein the first cap electroplated layer is selected in material from the group consisting of tin, copper, iron, silver, nickel and alloys thereof.

3. The surge-resistant wire-wound resistor of claim 2, wherein the thickness of the first cap electroplated layer is from 1 μm to 10 μm.

4. The surge-resistant wire-wound resistor of claim 1, wherein the second cap electroplated layer is in material selected from the group consisting of tin, copper, iron, silver, nickel and alloys thereof.

5. The surge-resistant wire-wound resistor of claim 4, wherein the thickness of the second cap electroplated layer is from 1 μm to 10 μm.

6. The surge-resistant wire-wound resistor of claim 1, wherein a material of the first insulating layer is epoxy resin, nonflammable silicone paint or enamel paint.

7. The surge-resistant wire-wound resistor of claim 1, wherein a material of the second insulating layer is epoxy resin, nonflammable silicone paint or enamel paint.

8. A manufacturing method for a surge-resistant wire-wound resistor, comprising:

providing a ceramic rod;

mounting a first cap and a second cap respectively on a first end and a second end of the ceramic rod;

winding a wound metal wire around the circumference of the ceramic rod;

soldering two ends of the wound metal wire onto the first cap and the second cap;

coating a first insulating layer on surrounding of the ceramic rod;

electroplating a cap electroplated layer respectively on surfaces of the first cap and the second cap;

connecting a first lead wire and a second lead wire to an axially extended line of the ceramic rod and extending the first and second lead wires outwardly from the first cap and the second cap; and coating a second insulating layer on a surface of the first insulating layer and surfaces of the first cap electroplated layer and the second cap electroplated layer.

* * * * *